US006290570B1

(12) United States Patent
Heesemann

(10) Patent No.: US 6,290,570 B1
(45) **Date of Patent: *Sep. 18, 2001**

(54) BELT GRINDING MACHINE

(76) Inventor: Juergen Heesemann, Bessinger Strasse 27, D-32547 Bad Oeynhausen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/361,409

(22) Filed: Jul. 27, 1999

(30) Foreign Application Priority Data

Jul. 28, 1998 (DE) ..... 198 33 881

(51) Int. Cl.[7] ..... B24B 49/00

(52) U.S. Cl. ..... 451/5; 451/5; 451/8; 451/9; 451/10; 451/300; 451/303

(58) Field of Search ..... 451/300, 303, 451/296, 5, 8, 9, 10, 11

(56) References Cited

U.S. PATENT DOCUMENTS 4,527,359 * 7/1985 Stump et al. ..... 451/303
4,601,134 * 7/1986 Hessemann ..... 451/303
4,839,994 * 6/1989 Hessemann ..... 451/303

FOREIGN PATENT DOCUMENTS 155 380 9/1985 (EP) .
0 571 343 A1 11/1993 (EP) .
571343 A1 * 11/1993 (EP) ..... B24B/21/08
5318305 * 3/1993 (JP) ..... B24B/21/06

OTHER PUBLICATIONS

Patent Abstracts of Japan, Sugitou Kasuke, 05318305, Dec. 3, 1993.

* cited by examiner

*Primary Examiner*—David A. Scherbel
*Assistant Examiner*—Shantese McDonald
(74) *Attorney, Agent, or Firm*—Foley & Lardner

(57) ABSTRACT

A belt grinding machine has a grinding belt continuously guided about at least two deflection rollers 2, a pressure shoe 3 that presses the grinding belt 1 against a workpiece 8 by a contact pressure apparatus. The belt grinding machine also has a contact pressure control that allows a contact pressure force to be set. The uniformity and reproducibility of the grinding results are improved by a detector arrangement 6, 7 that senses the adjustment of the pressure shoe 3 and an evaluation device that influences the contact pressure control as a function of the sensed adjustment of the pressure shoe 3.

26 Claims, 3 Drawing Sheets

BELT GRINDING MACHINE

BACKGROUND OF THE INVENTION

1. Field of the Invention

The invention relates to a belt grinding machine having a grinding belt continuously guided about deflection rollers, a pressure shoe for pressing the grinding belt against a workpiece via a contact pressure apparatus, and a contact pressure control whereby a contact pressure force can be set.

2. Description of Related Art

One such belt grinding machine is disclosed, for example, in EP 0 155 380 B1. That belt grinding machine has a segmented pressure beam having a large number of pressure shoes arranged side by side. Each pressure shoe can be controlled to be active or inactive through a detection device that detects the contour of the workpiece, so that only the pressure shoes that are actually needed for the workpiece are set into an active grinding position as the workpiece is conveyed through below the pressure beam by a conveyor device. The setting of the contact pressure force of the activated pressure shoes functions to press those pressure shoes, which have only a small area of contact with a marginal piece of the workpiece, against the workpiece with a reduced contact pressure force to prevent an undesirable rounded grinding of the edges of the workpiece. In this arrangement, the contact pressure force is preferably controlled by a solenoid, whose contact pressure force depends on the electrical power flowing through its coil windings. Other contact pressure devices, for example hydraulic or pneumatic pressure devices, may also be used.

The operation of this known device is as follows: the contour of the workpiece is detected; a contact pressure force is preset by the contact pressure control for the central region of the workpiece; and, in the case of solenoid actuation, the contact pressure control produces a predetermined current through the solenoid of the pressure shoe. A similar principle would apply if pneumatic or hydraulic drives were employed. Despite the sophistication of existing belt grinding machines, there is still room for improvement.

SUMMARY OF THE INVENTION

It is therefore a general object of the invention to provide a belt grinding apparatus that will alleviate or minimize problems occurring in the known alternatives.

A specific object of the invention is to provide a belt grinder with an optimal grinding result.

A preferred embodiment of the invention, which is intended to accomplish the above objectives, includes at least two deflection rollers; a grinding belt continuously guided about the deflection rollers; a pressure shoe that presses the grinding belt against a workpiece by a contact pressure apparatus; a contact pressure control whereby a contact pressure force can be set; a detector arrangement that senses the adjustment of the pressure shoe; and an evaluation device that adjusts the contact pressure control as a function of the sensed adjustment of the pressure shoe.

In addition to the above, the invention may include a plurality of pressure shoes and a conveyer for conveying the workpiece relative to the belt and the pressure shoes; a detection device that detects the contour of the workpiece, and a controller that activates and deactivates the pressure shoes in accordance with the detected contour of the workpiece.

BRIEF DESCRIPTION OF THE DRAWINGS

The accompanying drawings, which are incorporated in and constitute a part of the specification, illustrate a presently preferred embodiment of the invention, and, together with the above general description and the following detailed description, serve to explain the principles of the invention.

DETAILED DESCRIPTION OF THE PREFERRED EMBODIMENTS

Figure 1A:
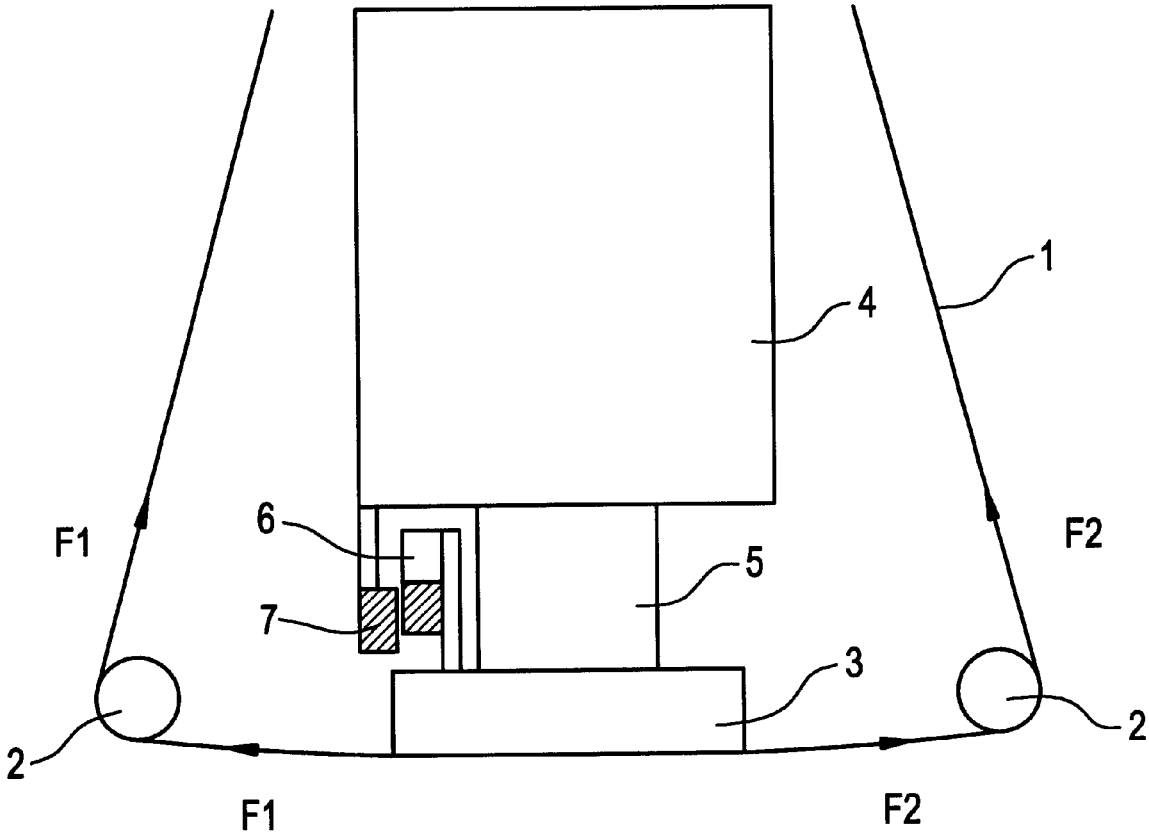
FIG. 1*a* is a diagrammatic arrangement of a solenoid-actuated pressure shoe which acts on a revolving grinding belt, with a slight adjustment of the pressure shoe for a thick workpiece.

FIG. 1*a* shows a grinding belt 1 guided about deflection rollers 2. Two deflection rollers 2 are shown FIG. 1, but more may be employed. A pressure shoe 3 is arranged between the deflection rollers 2 and can be pressed by a contact pressure apparatus, for example, a solenoid 4, against the grinding belt 1 between the deflection rollers 2. The pressure shoe 3 projects with a shank 5 into the solenoid 4 and is pushed out from the solenoid 4 by a predetermined current through the coil of the solenoid 4.

A permanent magnet 6 is mounted on the pressure shoe 3 and, together with a sensor 7, which is mounted in a stationary position on the housing of the solenoid 4, serves as a position detector for adjusting the travel of the pressure shoe 3. The sensor preferably is a magnetostrictive sensor or a Hall sensor.

Figure 1B:
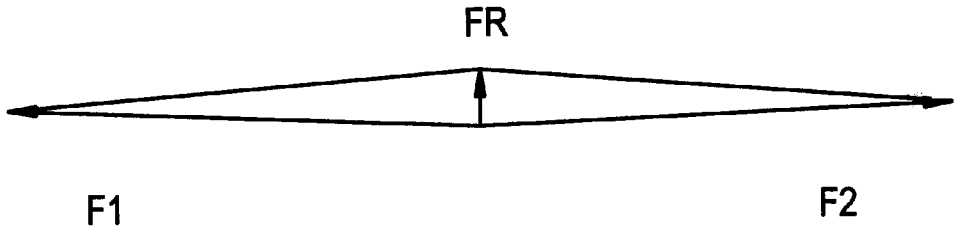
FIG. 1*b* a force diagram which reflects the operating condition of the apparatus as shown in FIG. 1*a;*
Figure 2A:
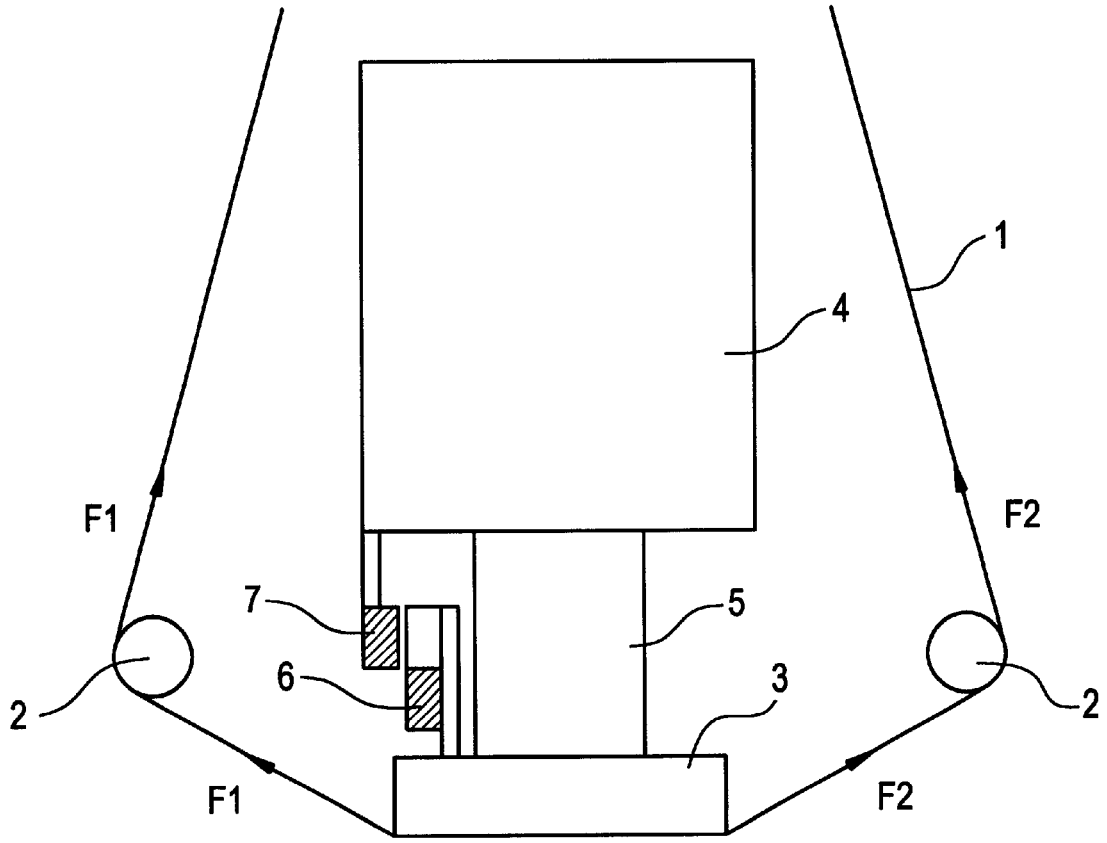
FIG. 2*a* is an illustration similar to FIG. 1, showing a large adjustment of the pressure shoe for a thin workpiece.
Figure 2B:
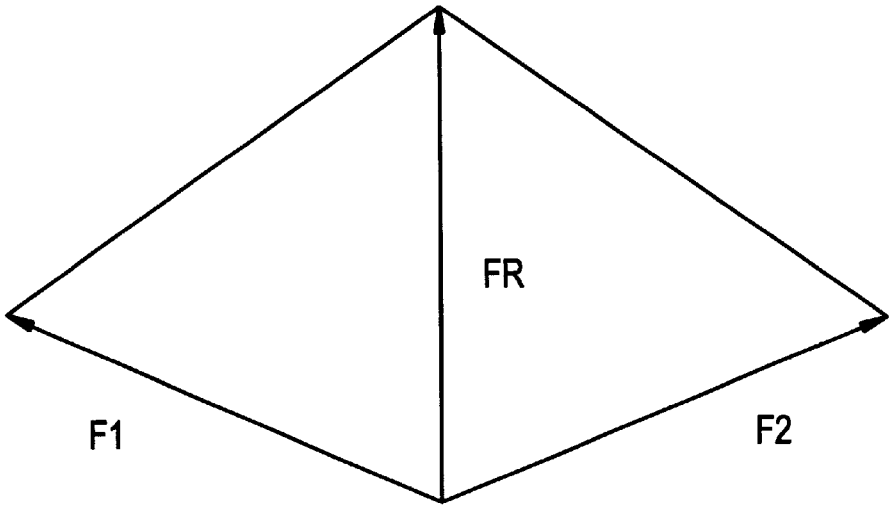
FIG. 2*b* is a force diagram which reflects the operating condition of the apparatus as shown in FIG. 2*a*.

Referring to FIG. 1*b*, the tension of the grinding belt 1 opposes a counterforce $F_R$ to the deviation movement of the grinding belt 1 out of the straight line path between the two deflection rollers 2 shown caused by the pressure shoe 3. The counterforce $F_R$, as shown by the force parallelogram, depends on the size of the two force vectors $F_1$ and $F_2$ extending from the pressure shoe 3 to the deflection roller 2. The counterforce $F_R$ also depends on the direction of the two vectors $F_1$, $F_2$. If the forces $F_1$, $F_2$ are of approximately equal size, then the slight deviation shown in FIG. 1*b* produces only a slight counterforce $F_R$. On the other hand, if there is a substantial adjustment of the pressure shoe 3 as shown in FIG. 2*a*, which results in a substantial deviation of the grinding belt 1 from the straight line path between the deflection rollers 2, then a substantially greater counterforce $F_R$ arises. See FIG. 2*b*. The extent of the deviation of the grinding belt 1, or of the adjustment of the pressure shoe 3, is measured by the detector arrangement 6, 7 and is used in an analysis device to generate a higher contact pressure force to compensate for the higher counterforce $F_R$, so that the resulting force acting on the workpiece is equal in both cases.

Similar considerations apply to changing the power/force characteristics of the solenoid 4 as a function of the adjustment travel of the pressure shoe 3. In this respect, the compensation is also controlled via the output signal from the detector arrangement 6, 7.

Figure 3:
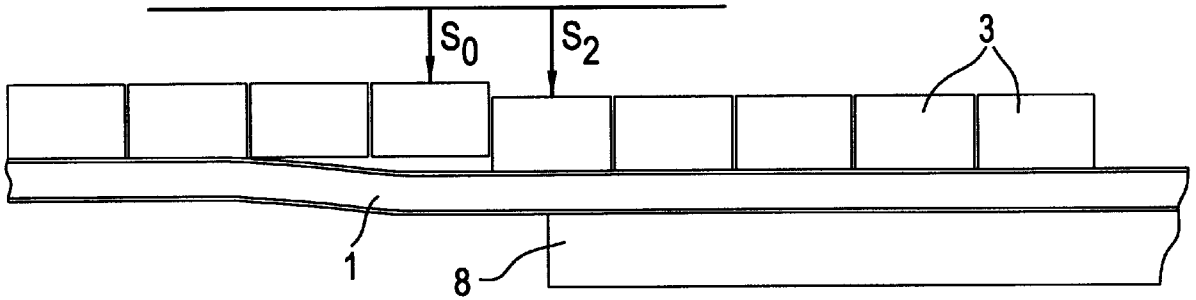
FIG. 3 PRIOR ART
FIG. 3 is a diagrammatic illustration of the adjustment of pressure shoes according to the prior art.

FIG. 3 diagrammatically shows the previously customary adjustment of the pressure shoes 3 for a workpiece 8 that is transported below the pressure shoes 3 and the grinding belt 1. All pressure shoes 3 that are flush with the contour of the workpiece 8 are set for grinding, in other words, the pressure shoes 3 are moved into a position $S_2$. The pressure shoes 3 that are not affected by the contour of the workpiece 8 remain in their position of rest $S_0$. The pressure shoe that acts only on a marginal region of the workpiece 8 has only a reduced contact pressure force.

Figure 4:
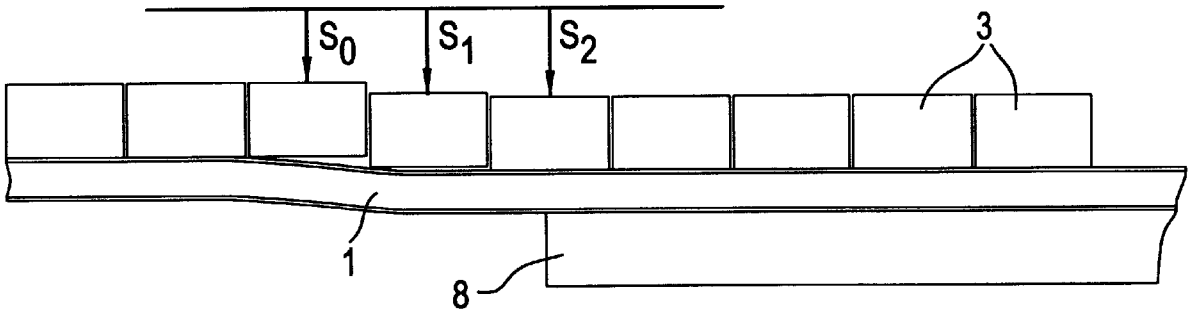
FIG. 4 is a diagrammatic illustration of the pressure shoe in the marginal region of the workpiece according to an example of embodiment of the invention.

According to an embodiment of the invention shown in FIG. 4, the grinding marginal pressure shoe 3 is still adjusted to position $S_2$ similar to the situation as shown in FIG. 3, but the adjoining pressure shoe is set to a position $S_1$, which is between the rest position $S_0$ and the grinding position $S_2$. This adjustment is possible, according to the invention, as a result of the position detection of the pressure shoes 3. Adjusting the pressure shoe 3 that is not needed for grinding to position $S_1$ reduces the undesirable grinding resulting from the deformation of the grinding belt 1 on the grinding marginal pressure shoe (position $S_2$).

Figure 5:
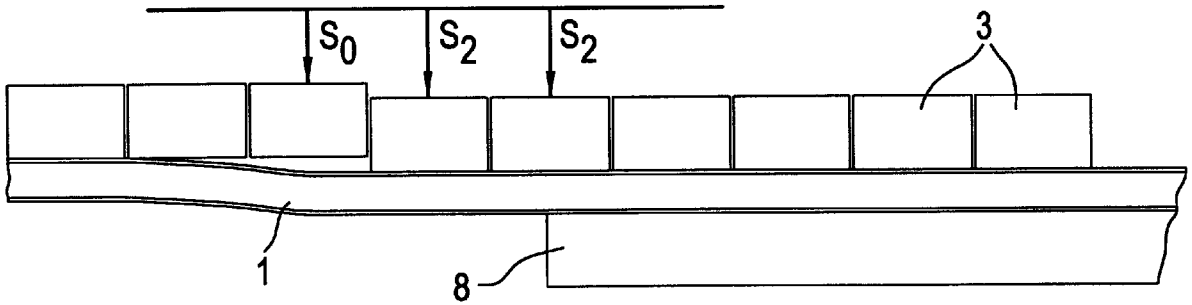
FIG. 5 is a diagrammatic illustration of the adjustment of pressure shoes at the marginal region of a workpiece according to a further embodiment of the invention.

In another embodiment of the invention shown in FIG. 5, the pressure shoe 3 that adjoins the grinding marginal pressure shoe 3 and that is no longer needed for grinding is also adjusted into position $S_2$. In other words, the pressure shoe next to the marginal pressure shoe is moved to position $S_2$ to relieve the grinding marginal pressure shoe of all reaction forces exerted by the grinding belt.

The alternative embodiments of the invention shown in FIGS. 4 and 5 are achieved through the detector arrangement 6, 7 sensing the adjustment of the pressure shoes 3. This result could not be achieved by merely controlling the contact pressure force F.

One beneficial effect of the invention resides in the fact that, although the control of the contact pressure force by the contact pressure device presses the pressure shoe toward the workpiece with a predetermined contact pressure force, it does so via the intervening, endlessly revolving grinding band. With a relatively thin workpiece, the pressure shoe will be adjusted significantly more than for a relatively thick workpiece. Because the grinding belt is continuously guided between deflection rollers, the greater deviation of the grinding belt also causes a greater counterforce as a result of the necessary belt tension of the grinding belt, not only because of the counterforce of a sprung bearing of a deflection roller of the grinding belt, which permits the deviation, but also because of the greater angle adopted by the grinding belt between the edge of the pressure shoe and the neighboring deflection roller. In a preferred embodiment of the invention, therefore, a change in the counterpressure of the grinding belt can be input into the evaluation device as a function of the deviation of the grinding belt, so that as a result of the measurement of the deviation by measurement of the adjustment of the pressure shoe the increased counterforce can be compensated by a correspondingly higher contact pressure force. As a result, the surface of a relatively thin workpiece is ground with the same contact pressure force—and hence with the same grinding result as the surface of a relatively thick workpiece.

The present invention further permits compensation for non-linear or fluctuating states of the travel/force characteristic of the contact pressure apparatus. Fluctuations of the solenoid excitation current causes adjustment of the pressure shoe. As a result of the detection, according to the invention, of the adjustment of the pressure shoe, it is possible to alter the contact pressure force correspondingly if the travel/force characteristic of the contact pressure device is input into the evaluation device, which can be done manually in advance but also by measurement of the contact pressure force during operation.

Particularly advantageous applications of the present invention arise in the case of those belt grinding machines having a multiplicity of pressure shoes arranged side by side and forming a pressure beam acting on the same grinding belt, a conveyor for conveying the workpiece relative to the pressure beam, a detection device for the contour of the workpiece and a control for activating and deactivating the pressure shoes as a function of the signal from the detection device.

In addition to the advantageous reduction possible in this case of the contact pressure force in the marginal region of the workpiece, it may be practical, according to the invention, to limit the adjustment of pressure shoes, especially in the marginal region of a workpiece, by a detected adjustment of at least one pressure shoe in another region of the workpiece, preferably in a central region. This ensures that there are no cases whatsoever in which increased grinding action takes place in sensitive regions.

The invention further permits those pressure shoes which are needed for the grinding of the workpiece, because they specifically lie outside the contour of the workpiece, also to be adjusted, at least partially, in order to achieve the result that the grinding belt does not produce a relatively high curvature—and hence a relatively high counterforce—at the pressure shoe which is still just active at the margin of the workpiece, which would result in an undesirable reduction of the contact pressure force in this region. As a result of the adjustment of the adjacent pressure shoe, which is no longer needed for grinding, toward the workpiece, the marginal pressure shoe needed for grinding follows virtually the same, essentially linear path of the grinding belt as the those pressure shoes that lie further in on the workpiece.

Various modifications will be apparent to those skilled in the art without departing from the true scope of the invention, which is limited only by the appended claims.

What is claimed is:

1. The belt grinding machine comprising:

at least two deflection rollers;

a grinding belt continuously guided about the deflection rollers;

a pressure shoe that presses the grinding belt against a workpiece by a contact pressure apparatus;

a contact pressure control whereby a contact pressure force can be set;

a detector arrangement that senses the adjustment of the pressure shoe; and an evaluation device that adjusts the contact pressure control as a function of the sensed adjustment of the pressure shoe, wherein a change in the counterpressure of the grinding belt can be input into the evaluation device as a function of the deviation of the grinding belt.

2. The belt grinding machine as claimed in claim 1, wherein there are a plurality of pressure shoes arranged side by side to form a pressure beam acting on the same grinding belt.

3. The belt grinding machine as claimed in claim 2, further comprising:

a conveyor for conveying the workpiece relative to the pressure beam;

a detection device that detects a contour of the workpiece; and a controller that activates and deactivates the pressure shoes depending on a signal from the detection device.

4. A belt grinding machine as claimed in claim 1, wherein the detector arrangement includes a sensor.

5. A belt grinding machine as claimed in claim 4, wherein the sensor is a magnetostrictive sensor.

6. A belt grinding machine as claimed in claim 5, wherein the sensor is a Hall sensor.

7. A belt grinding machine as claimed in claim 1, wherein there are a plurality of pressure shoes arranged side by side to form a pressure beam that acts on the grinding belt.

8. The belt grinding machine comprising:

at least two deflection rollers;

a grinding belt continuously guided about the deflection rollers;

a pressure shoe that presses the grinding belt against a workpiece by a contact pressure apparatus;

a contact pressure control whereby a contact pressure force can be set;

a detector arrangement that senses the adjustment of the pressure shoe; and an evaluation device that adjusts the contact pressure control as a function of the sensed adjustment of the pressure shoe, wherein the force/travel characteristic of the contact pressure device can be input into the evaluation device.

9. The belt grinding machine as claimed in claim 8 wherein there are a plurality of pressure shoes arranged side by side to form a pressure beam acting on the same grinding belt.

10. The belt grinding machine as claimed in claim 9, further comprising:

a conveyor for conveying the workpiece relative to the pressure beam;

a detection device that detects a contour of the workpiece; and a controller that activates and deactivates the pressure shoes depending on a signal from the detection device.

11. A belt grinding machine as claimed in claim 8 wherein the detector arrangement includes a sensor.

12. A belt grinding machine as claimed in claim 11 wherein the sensor is a magnetostrictive sensor.

13. A belt grinding machine as claimed in claim 11 wherein the sensor is a Hall sensor.

14. A belt grinding machine as claimed in claim 8 wherein there are a plurality of pressure shoes arranged side by side to form a pressure beam that acts on the grinding belt.

15. A belt grinding machine comprising:

at least two deflection rollers;

a grinding belt continuously guided about the deflection rollers;

a pressure shoe that presses the grinding belt against a workpiece by a contact pressure apparatus;

a contact pressure control whereby a contact pressure force can be set;

a detector arrangement that senses the adjustment of the pressure shoe; and an evaluation device that adjusts the contact pressure control as a function of the sensed adjustment of the pressure shoe, wherein there are a plurality of pressure shoes arranged side by side to form a pressure beam acting on the same grinding belt, and the belt grinding machine further comprising:

a conveyor for conveying the workpiece relative to the pressure beam;

a detection device that detects a contour of the workpiece; and a controller that activates and deactivates the pressure shoes depending on a signal from the detection device, wherein the controller adjusts one pressure shoe based on a detected adjustment of another pressure shoe in a different region of the workpiece.

16. A belt grinding machine as claimed in claim 15 wherein the detector arrangement includes a sensor.

17. A belt grinding machine as claimed in claim 16 wherein the sensor is a magnetostrictive sensor.

18. A belt grinding machine as claimed in claim 16 wherein the sensor is a Hall sensor.

19. A belt grinding machine comprising:

at least two deflection rollers;

a grinding belt continuously guided about the deflection rollers;

a pressure shoe that presses the grinding belt against a workpiece by a contact pressure apparatus;

a contact pressure control whereby a contact pressure force can be set;

a detector arrangement that senses the adjustment of the pressure shoe; and an evaluation device that adjusts the contact pressure control as a function of the sensed adjustment of the pressure shoe, wherein there are a plurality of pressure shoes arranged side by side to form a pressure beam acting on the same grinding belt, and the belt grinding machine further comprising:

a conveyor for conveying the workpiece relative to the pressure beam;

a detection device that detects a contour of the workpiece; and a controller that activates and deactivates the pressure shoes depending on a signal from the detection device, wherein the controller adjusts one pressure shoe in the marginal region depending on a detected adjustment of at least one pressure shoe at an approximate center of the workpiece.

20. A belt grinding machine as claimed in claim 19 wherein the detector arrangement includes a sensor.

21. A belt grinding machine as claimed in claim 20 wherein the sensor is a magnetostrictive sensor.

22. A belt grinding machine as claimed in claim 20 wherein the sensor is a Hall sensor.

23. A belt grinding machine comprising:

at least two deflection rollers;

a grinding belt continuously guided about the deflection rollers;

a pressure shoe that presses the grinding belt against a workpiece by a contact pressure apparatus;

a contact pressure control whereby a contact pressure force can be set;

a detector arrangement that senses the adjustment of the pressure shoe; and an evaluation device that adjusts the contact pressure control as a function of the sensed adjustment of the pressure shoe, wherein there are a plurality of pressure shoes arranged side by side to form a pressure beam that acts on the grinding belt, and wherein the belt grinding machine further comprises:

a conveyor for conveying the workpiece relative to the pressure beam;

a detection device that detects a contour of the workpiece; and a controller that activates and deactivates the pressure shoes based on a signal from the detection device, wherein the evaluation device at least partially adjusts one of the pressure shoes, that is not needed for grinding the workpiece, based on detected adjustment of another pressure shoe which is active at the margin of the workpiece.

24. A belt grinding machine as claimed in claim 23 wherein the detector arrangement includes a sensor.

25. A belt grinding machine as claimed in claim 24 wherein the sensor is a magnetostrictive sensor.

26. A belt grinding machine as claimed in claim 24 wherein the sensor is a Hall sensor.

* * * * *